US005868522A

United States Patent [19]

Campbell

[11] Patent Number: 5,868,522

[45] Date of Patent: Feb. 9, 1999

[54] VIBRATORY SCREED ASSEMBLY FOR AN ASPHALT PAVING MACHINE

[75] Inventor: Thomas Roger Campbell, Chattanooga, Tenn.

[73] Assignee: Astec Industries, Inc., Chattanooga, Tenn.

[21] Appl. No.: 783,434

[22] Filed: Jan. 16, 1997

[51] Int. Cl.[6] ..... E01C 19/38

[52] U.S. Cl. ..... 404/114; 404/118

[58] Field of Search ..... 404/72, 75, 102, 404/114, 118, 120, 119, 96, 104, 117, 133.05, 133.2

[56] References Cited

U.S. PATENT DOCUMENTS

| | | | |
|---|---|---|---|
| 3,545,349 | 12/1970 | Otterman et al. | 94/46 |
| 3,817,644 | 6/1974 | Matson | 404/114 |
| 3,838,933 | 10/1974 | Lehman et al. | 404/114 |
| 3,841,777 | 10/1974 | Domenighetti | 404/114 X |
| 3,883,259 | 5/1975 | Berg et al. | 404/120 |
| 3,969,056 | 7/1976 | Larsen et al. | 425/218 |
| 4,068,970 | 1/1978 | Rowe | 404/120 |
| 4,272,213 | 6/1981 | McGovarin | 404/118 |
| 4,340,351 | 7/1982 | Owens | 425/456 |
| 4,427,358 | 1/1984 | Stilwell | 425/432 |
| 4,493,585 | 1/1985 | Axer | 404/102 |
| 4,577,994 | 3/1986 | Miller | 404/114 |
| 4,619,552 | 10/1986 | Sadahiro | 404/117 |
| 4,685,826 | 8/1987 | Allen | 404/114 |
| 4,722,636 | 2/1988 | Brock | 404/118 X |
| 4,759,657 | 7/1988 | Dorr et al. | 404/72 |
| 4,838,730 | 6/1989 | Owens | 404/114 |
| 4,930,935 | 6/1990 | Quenzi et al. | 404/75 |
| 4,950,101 | 8/1990 | Artzberger | 404/114 |

FOREIGN PATENT DOCUMENTS

| | | | |
|---|---|---|---|
| 243647 | of 1969 | U.S.S.R. | 404/114 |

*Primary Examiner*—James A. Lisehora

*Attorney, Agent, or Firm*—Chambliss, Bahner & Stophel, P.C.

[57] ABSTRACT

A screed assembly is disclosed for an asphalt paving machine that is used to pave the surface of a roadway with asphalt concrete paving material. This screed assembly includes a frame portion that is adapted for attachment to the paving machine, and a vibratory screed portion that is adapted for attachment to the frame portion. The vibratory screed portion includes a screed plate that is disposed towards the surface of the roadway, and a vibratory assembly which is mounted to the screed plate so as to impart vibration thereto. This vibratory assembly includes an elongate shaft, means for rotating the shaft, and an eccentric weight that is mounted on the shaft, which weight has a non-symmetrical distribution of mass about the shaft so that vibration will be created upon rotation thereof. The screed assembly also includes means for isolating the vibratory assembly so as to limit the transmission of vibration created thereby to the frame portion.

20 Claims, 7 Drawing Sheets

VIBRATORY SCREED ASSEMBLY FOR AN ASPHALT PAVING MACHINE

FIELD OF THE INVENTION

This invention relates to paving machines that are used to pave the surface of a roadway with asphalt concrete paving materials. More particularly, it relates to the screed assembly of such a paving machine that is used to level the asphalt concrete paving material after deposition on the roadway and to provide compaction for such material.

BACKGROUND OF THE INVENTION

The screed assembly for an asphalt paving machine is employed to level and grade the asphalt concrete material that is deposited by the paving machine on the roadway, as well as to provide initial compaction for the newly applied pavement surface. Consequently, the screed assembly establishes the initial thickness of the layer of paving material that is placed on the roadway by the paving machine. In order to accomplish this, the screed assembly is typically adapted to be towed by or pulled behind the tractor unit of the paver. The screed or screed assembly is usually attached to the tractor by means of a pair of side arms or pull arms at a single point (the tow or pull point) on either side of the machine. The attachment is typically a pivotal connection that allows the screed to float freely on the mat of paving material that has been deposited on the roadway. This allows the screed to average out changes in grade that are spanned by the wheels or crawler assemblies of the paver tractor.

The angle assumed by the lower surface of the screed as it floats on the mat of paving material is referred to as the angle of attack. The forces on the screed must be in equilibrium for the screed to remain at a constant angle of attack as it is towed by the tractor. There are two primary forces that constantly act on the paver screed as the paver places the paving material on the roadway, and changes in these forces change the angle of attack assumed by the screed. The first force acting on the screed is the towing force of the tractor, which varies as the speed of the tractor changes. The second force is due to the head of paving material deposited behind the tractor pushing against the screed. As the amount of such material deposited behind the tractor changes, the force acting on the screed also changes. When a change in forces acting on the screed occurs, the screed will rise or fall, changing its angle of attack, and this will change the thickness of the mat being placed. The screed will continue to react to a change in forces acting against it until it reaches a new equilibrium angle of attack in which the forces are again in balance.

It is known that the service life of an asphalt surface layer on a roadway depends largely on the reduction of voids therein to the smallest possible volume. The determining factor in void volume is the degree of compaction imparted to the asphalt mat. It is generally considered desirable that the surface layer of an asphalt roadway have a degree of compaction of at least about 96–98%. In order to achieve this degree of compaction, therefore, the air voids in a mat or layer of asphalt must be reduced so as to occupy no more than about 2–4% of the volume of the asphalt mat.

The amount of compaction imparted to the asphalt mix is a function of many variables. The properties of the mix itself are very important. The temperature, amount of asphalt cement, and moisture in the mix all affect the forces required to compact the mix. In practice, it has generally been necessary, in order to achieve the desired degree of compaction, to provide a screed assembly on the paving machine having a front-mounted hydraulically operated tamper or compactor bar to precompact the asphalt mat, followed by a leveling screed plate that provides additional compaction. The tamper that is typically mounted on the screed assembly is provided with an oblique leading face that compresses the asphalt concrete material as it passes thereover, and a hydraulic ram that compacts it beneath the bar. The following leveling screed plate then acts to close and smooth the asphalt surface, although the compaction obtained by use of this screed assembly will typically be no greater than about 86–92%. In order to obtain the desired degree of compaction, it is generally necessary to provide a separate compaction step by making one or more passes over the partially-compacted asphalt mat with a compacting roller.

It is also known to adapt the leveling screed plate for vibration in order to enhance its leveling and smoothing action, and to permit it to provide an additional measure of compaction to the asphalt mat. A typical vibratory screed for an asphalt concrete paving machine is provided with an elongate shaft, means for rotating the shaft, and one or more eccentric weights that are mounted on the shaft so that vibration will be created upon rotation thereof. One example of such a vibratory screed assembly is described in U.S. Pat. No. 3,545,349 of Otterman et al. The Otterman screed includes a front plate that is adjustable with regard to its angle of inclination, a tamper or compactor bar that is arranged immediately behind the plate, and a smoothing screed plate behind the tamper. The tamper is suspended at both ends from an eccentric drive which imparts vibration to the tamper through a motor-driven shaft on which a cam disc is attached, in order to provide a tamping action that imparts a measure of compaction of the asphalt mat. In addition, the screed plate is vibrated by means of a rotary driven shaft carrying eccentrically-mounted weights for generating pulsating vibratory forces in all directions in planes extending perpendicular to the shaft.

The frequency of vibration and the amplitude of vibratory forces applied by such a vibratory mechanism that is installed on a screed assembly will affect the amount of compaction imparted through the assembly to the asphalt mat. The frequency of vibration of a rotary-driven shaft carrying eccentrically-mounted weights is controlled by the rotary speed of the vibrator shaft, and the amplitude of vibratory forces is controlled by the size and location of the eccentric weights on the shaft. The amount of compaction imparted by a screed plate equipped with such vibratory mechanism is also affected by the size and mass of the screed plate and the speed of the paver screed. The faster the paver moves, the less time the screed will reside over any particular area in the new pavement mat, and thus, the less the degree of compaction imparted.

Another variable in the amount of compaction imparted by a vibratory screed assembly is the efficiency by which such assembly operates. Generally, the greater the amount of generated forces that are applied in the vertical direction, the greater the amount of compaction imparted to the pavement mat. In addition, the greater the amount of generated forces that are applied to the pavement mat, the less is the need for subsequent rolling or compacting operations. However, the vibration imparted to the screed plate in a vibratory screed assembly is normally limited to no more than twice the total weight of the assembly. A greater resultant force would cause the screed assembly to bounce or jump on the asphalt mat, which would result in damage to the asphalt surface and the screed assembly.

The typical vibratory screed does not efficiently transmit the forces generated by the vibratory assembly to the asphalt pavement, because the forces transmitted by a rotating eccentrically mounted weight are not restricted to the vertical direction, but also include forces acting in the travel direction of the paver, or obliquely thereto. Because the typical vibratory screed does not efficiently transmit compacting forces to the asphalt pavement, subsequent rolling operations are required to achieve the desired degree of compaction. Furthermore, because the asphalt mat is not properly compacted as it is applied, the subsequent rolling operations may cause roll-out of asphalt concrete material at the edges of the roadway. Such roll-out, where asphalt concrete material at the edge of the roadway is squashed out laterally under the influence of the compacting force of the roller, may create an uneven edge on the asphalt mat and may cause the edge to crumble or fail. This may create considerable difficulty in matching the density of asphalt mats that are joined longitudinally, such as at the center of a road. In addition, because the rolling machine is usually not the same width as the paving machine, it is sometimes difficult to provide uniform compaction to the entire width of the asphalt mat being laid.

In addition to inefficiently transmitting compacting forces to the pavement, the typical vibratory screed can have other deleterious effects on the paving operation. If vibrations generated by the vibratory screed are transmitted through the pull arms to the tractor of the paver instead of to the pavement, damage to the pivotal connection of the screed assembly or to the tractor itself may result. Furthermore, the transmission of such vibrations to the tractor can affect the deposit of asphalt material by the paver, and in some cases may even be felt by the paver operator.

U.S. Pat. No. 4,493,585 of Axer describes a vibratory screed mechanism that attempts to address some of the functional deficiencies in typical vibratory screed assemblies noted above. However, Axer's solution is a complicated, multi-component mechanism that includes five principal subassemblies. First, Axer employs a leveling blade, followed by a vertically moveable ramming bar and a first leveling screed plate. Located to the rear of the first leveling screed plate is a compactor bar, followed by second leveling screed plate that is mounted on a lower plane than the first plate. The ramming bar is operatively connected to an eccentric drive, which provides a vertical tamping action at the leading face of the first leveling screed plate. Between the first leveling screed plate and the second leveling screed plate, the compactor bar is arranged for vertical compacting action, and both screed plates may also be provided with a vibrator device. Axer's device also includes a complicated arrangement for transmitting vibratory forces from the eccentrically weighted drive shaft to the asphalt pavement mat, including push rods, followers, guide rods and springs, as well as a pressure beam.

It would be desirable, however, if a more efficient vibratory screed could be developed for an asphalt paving machine that would transmit greater compacting forces to the asphalt pavement mat without requiring a complicated force-transmitting mechanism, or an increase in the mass of the screed or the power supplied to the vibratory mechanism. It would also be desirable if a vibratory screed could be developed that would be capable of imparting significant vibratory forces to the asphalt pavement mat without requiring the use of a precompacting tamper or a plurality of ramming and compacting bars. In addition, it would be desirable if a vibratory screed of relatively simple design could be developed that is susceptible to adaptation for use on paving machines of various widths. It would also be desirable if a vibratory screed assembly could be developed that would permit compaction of the asphalt mat to the desired density as it is laid, so that subsequent rolling operations could be minimized or eliminated. Finally, it would be desirable if an improved vibratory screed could be developed for use in connection with an asphalt paving machine that would minimize the vibratory forces transmitted to the tractor of the paving machine.

OBJECTS AND ADVANTAGES OF THE INVENTION

Accordingly, it is an object of the invention claimed herein to provide an improved vibratory screed for use in connection with an asphalt paving machine, which screed is adapted to transmit greater vibratory forces than was previously thought possible to the asphalt pavement mat that is laid down by the paving machine. It is another object of this invention to provide such an improved screed that is capable of transmitting greater compacting forces to the asphalt pavement mat without requiring a complicated force-transmitting mechanism, or an increase in the mass of the screed or the power supplied to the vibratory mechanism of the screed. It is yet another object of this invention to provide an improved vibratory screed that minimizes the vibratory forces transmitted to the tractor of the paving machine. Another object of this invention is to provide a vibratory screed of relatively simple design that is susceptible to being adaptable to use on asphalt paving machines of various widths. Still another object of this invention is to provide an improved vibratory screed assembly that permits compaction of the asphalt mat to a level at or near the final desired density as it is laid, so that subsequent rolling or other compacting operations may be minimized or eliminated. It is also an object of this invention to provide a method for paving a roadway with asphalt concrete using an asphalt paving machine that employs such an improved vibratory screed to limit the transmission of vibration to the tractor of the paving machine and to maximize the transmission of compacting forces to the asphalt concrete material on the roadway.

Additional objects and advantages of this invention will become apparent from an examination of the drawings and the ensuing description.

SUMMARY OF THE INVENTION

The invention comprises a screed assembly for an asphalt paving machine and a method for using such assembly in paving the surface of a roadway with asphalt concrete paving material. This screed assembly includes a frame portion and a vibratory screed portion. The frame portion is adapted for attachment to the paving machine, and the vibratory screed portion is adapted for attachment to the frame portion. The vibratory screed portion includes a screed plate that is disposed towards the surface of the roadway and a vibratory assembly. The vibratory assembly, which is mounted to the screed plate so as to impart vibration thereto, includes an elongate shaft, means for rotating the shaft, and an eccentric weight that is mounted on the shaft and that has a non-symmetrical distribution of mass about the shaft so that vibration will be created upon rotation thereof. The invention also includes means for isolating the vibratory assembly so as to limit the transmission of vibration created thereby to the frame portion and to the tractor of the paving machine while maximizing the transmission of vibratory forces to the asphalt pavement surface.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS

Figure 1:
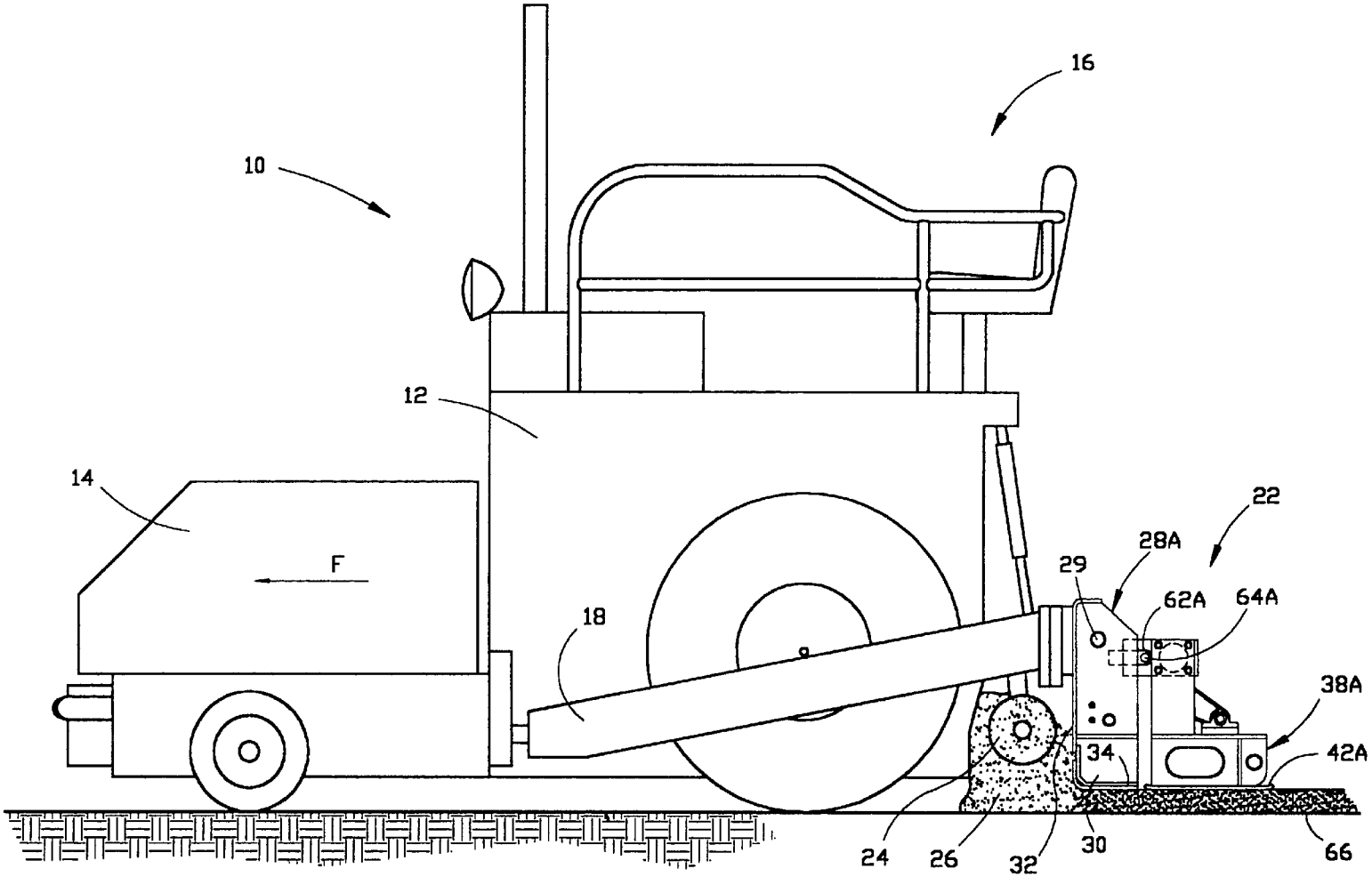
FIG. 1 is a side view of an asphalt paving machine which includes a first embodiment of the improved vibratory screed assembly described and claimed herein.

Referring now to the drawings, a self-propelled paving machine 10 for use in paving the surface of a roadway with asphalt concrete paving material is illustrated in FIG. 1. This machine includes a tractor 12 having drive means for propelling the machine along the surface of a roadway, a hopper 14 for holding a quantity of asphalt concrete paving material and means for conveying the paving material from the hopper to the roadway behind the machine, many of the components of which are not shown. Mounted atop the paving machine is an operator's station 16. Machine 10 is adapted to travel in the direction of arrow F. Attached to the rear of machine 10 by means of a pair of side arms (one of which is labeled with the numeral 18) is vibratory screed assembly 22, one of the preferred embodiments of the invention.

In use, machine 10 is moved along the surface of the roadway in the direction F and asphalt concrete paving material is conveyed from hopper 14 to the rear of the machine where it is deposited on the roadway in front of screed assembly 22 by means of transverse distributing auger 24. The deposited asphalt concrete material at 26 is of a relatively loose density.

Figure 2:
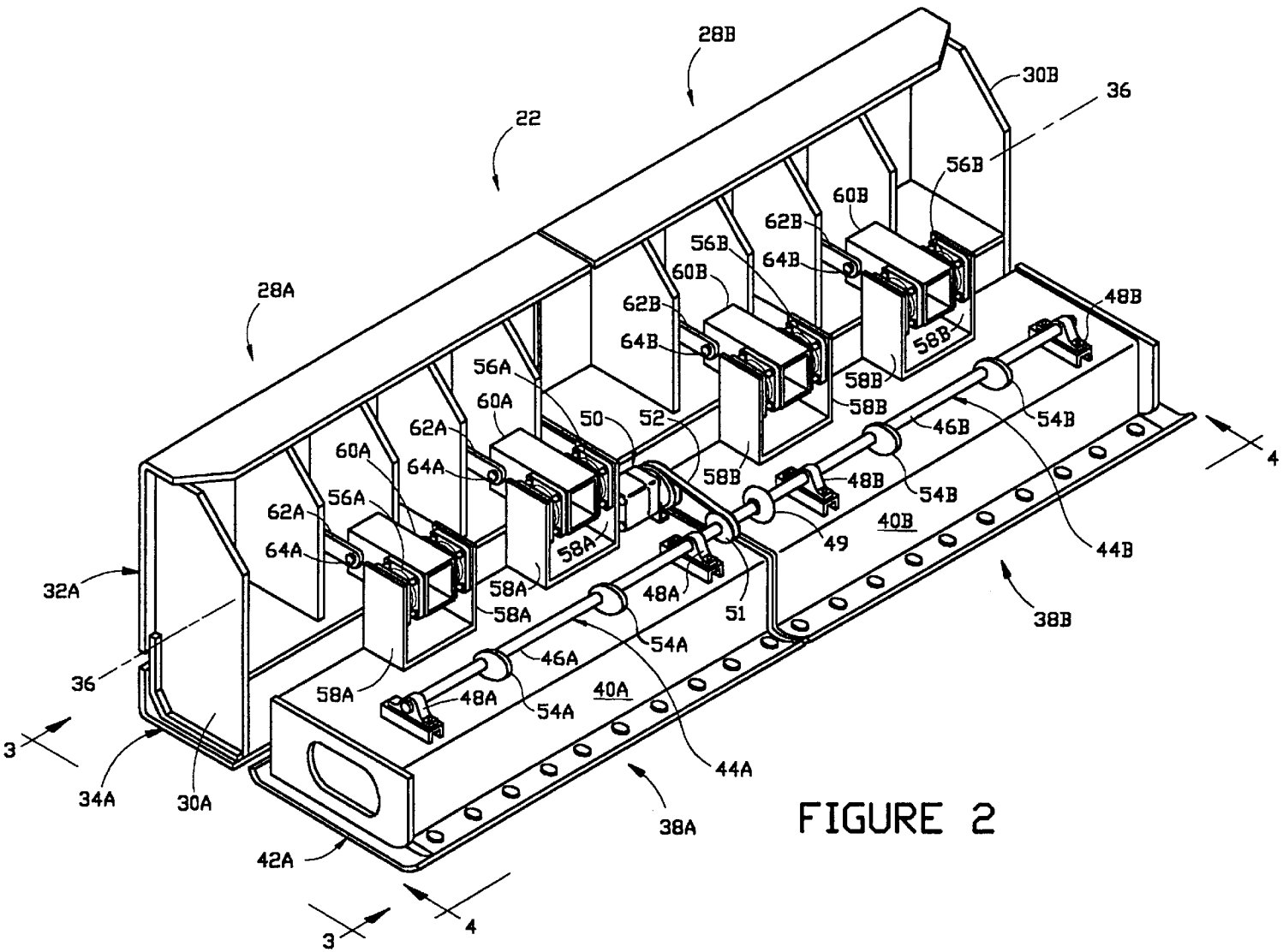
FIG. 2 is a perspective view of the vibratory screed assembly of FIG. 1.
Figure 3:
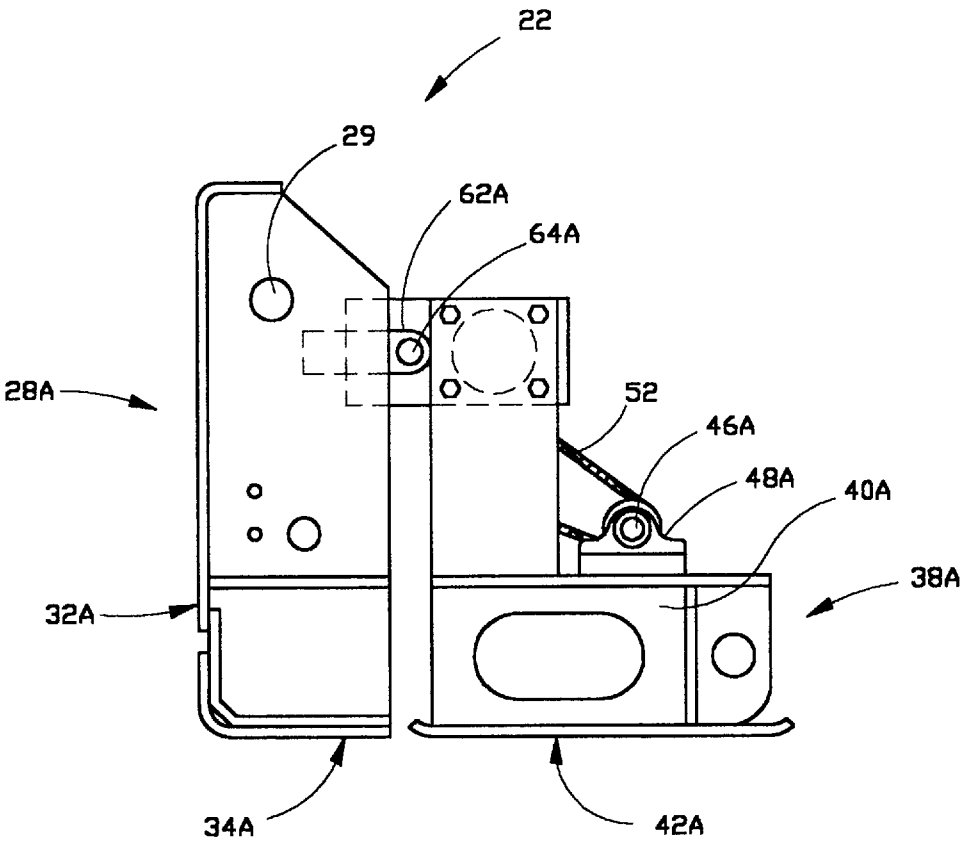
FIG. 3 is a side view of the vibratory screed assembly of FIG. 2, taken along lines 3—3.
Figure 4:
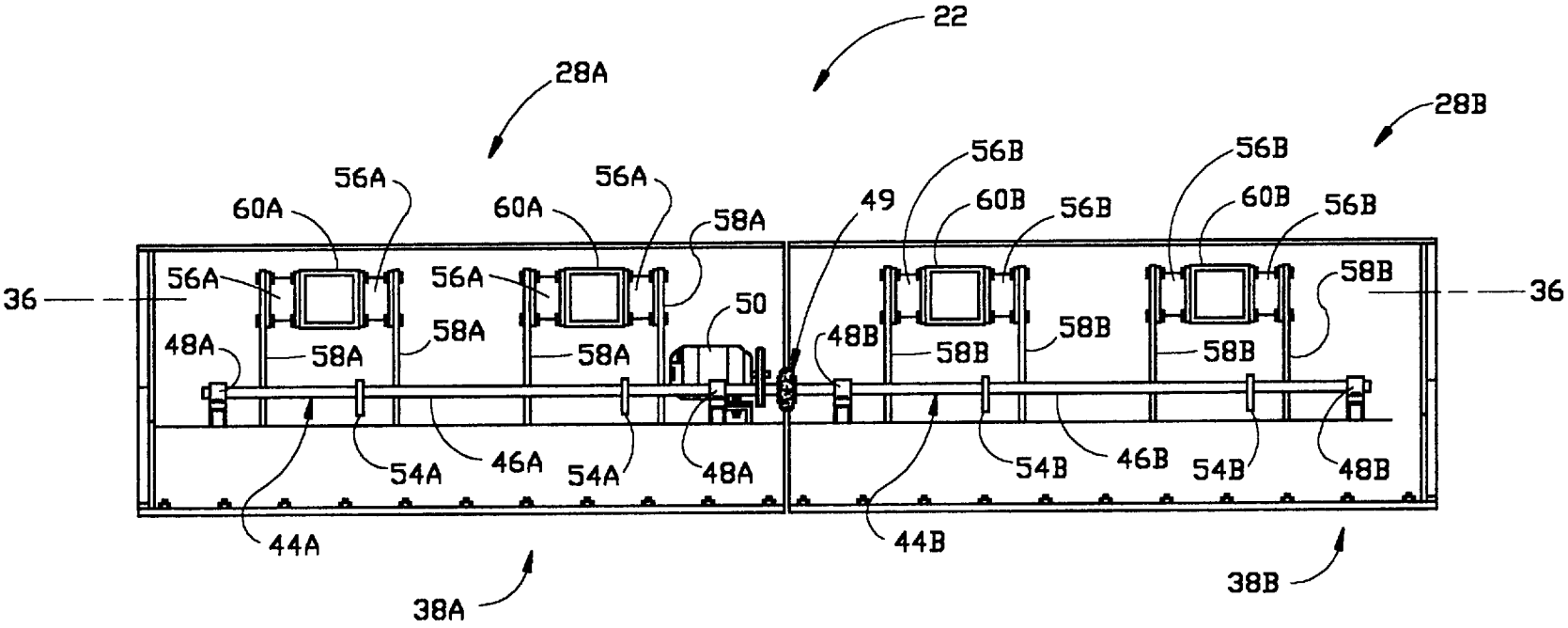
FIG. 4 is a rear view of the vibratory screed assembly of FIG. 2, taken along lines 4—4.

FIGS. 2 through 4 illustrate a first embodiment of the improved vibratory screed assembly that is described and claimed herein. This embodiment, assembly 22, includes a frame portion that is adapted for attachment to the paving machine through side arms 18. Preferably, assembly 22 includes a pair of frame portions in the form of prescreeds 28A and 28B, disposed side-by-side, as shown in FIGS. 2 and 4. As used herein, the letters "A" and "B" following numerals will designate identical or mirror-image components of portions of the first preferred embodiment of the invention, assembly 22. The prescreeds are preferably pivotally attached to the paving machine through the side arms so as to be capable of pivoting about pivot axis 29 or another axis that is disposed parallel to the surface of the roadway and transverse to the direction of travel F of the machine. Prescreed 28A includes frame 30A, to which is attached strike-off face 32A that is disposed towards the paving machine 10, and leveling face 34A that is disposed towards the surface of the roadway. Preferably, these components are made of heavy-gauge steel or other suitable material. In connection with the operation of paving machine 10, strike-off faces 32A and 32B of prescreed portions 28A and 28B will serve to level the asphalt deposited on the roadway by the distributing auger, and leveling faces 34A and 34B will smooth the surface of the asphalt mat so leveled.

Assembly 22 also includes a vibratory screed portion that is adapted for attachment to the frame portion. Preferably, assembly 22 includes a pair of vibratory screed portions 38A and 38B, disposed side-by-side, as shown in FIGS. 2 and 4. As used herein, the letters "A" and "B" following numerals will designate identical or mirror-image components of portions of the first preferred embodiment of the invention, assembly 22. Preferably the vibratory screed portion or portions of assembly 22 are adapted for attachment to the frame portion or portions about an axis 36 that is parallel to the surface of the roadway and transverse to the direction of travel F of the machine. Vibratory screed portion 38A includes frame 40A, to which is attached screed plate 42A that is disposed towards the surface of the roadway. Preferably, these components are made of heavy-gauge steel or other suitable material. In addition, vibratory screed portion 38A includes vibratory assembly 44A, which is mounted to frame 40A so as to impart vibration thereto. Of course, frame 40A, although a preferred component of assembly 22, could be deleted and vibratory assembly 44A could be mounted directly on screed plate 42A. Vibratory assembly 44A includes elongate shaft 46A, and a means for rotating the shaft. Preferably, the shaft of each vibratory assembly is supported by and journaled in at least one bearing assembly, such as assemblies 48A.

As has been mentioned, preferred screed assembly 22 includes a pair of prescreed portions 28A and 28B, disposed side-by-side, and a pair of vibratory screed portions 38A and 38B, also disposed side-by-side. Preferably, shafts 46A and 46B of the vibratory assemblies of the vibratory screed portions are joined together with a flexible coupling, such as coupling 49, which may be made of a plastic, elastomeric or other suitable material, and means are provided for rotating both shafts together, such as motor 50, which may preferably be of hydraulic or electric motive power. The motor may be operatively attached to the shaft by means of pulley 51 and belt 52, as shown in FIG. 2, or by any other convenient means of attachment.

It is contemplated that any convenient number of such assembly portions may be provided and joined together in the manner of the first embodiment of the invention illustrated in FIGS. 2 through 4 or in another known manner to provide an assembly of the desired width. It is also contemplated that a motor may be provided for each vibratory screed portion, or a motor may be selected so as to power two or more such vibratory screed portions.

Vibratory assembly 44A also includes at least one eccentric weight 54A that is mounted on the shaft, said weight having a non-symmetrical distribution of mass about the shaft so that vibration will be created upon rotation thereof. Preferably, the vibratory assembly includes a plurality of such weights that are mounted on the shaft in such fashion that they have a non-symmetrical distribution of mass about the shaft so that vibration will be created upon rotation thereof. If a plurality of vibratory screed portions are utilized, as is illustrated in FIGS. 2 and 4, it is preferred that the rotation of the shafts be synchronized and the alignment of the eccentric weights thereon be aligned so that vibratory forces created on one vibratory screed portion are not canceled by such forces created on another vibratory screed portion, but instead that they reinforce each other.

Ideally, the improved screed assembly that is described herein may be utilized to provide a degree of compaction to the asphalt concrete mat of at least about 98%. This amount of compaction may be achieved because the improved screed assembly includes a frame portion that is a separate component of the assembly from the vibratory screed portion, and because the vibratory screed portion is isolated from the frame portion so as to limit the transmission of vibratory forces to the frame portion of the assembly and to concentrate the transmission of such forces to the asphalt pavement. It is believed that the provision of separate frame and vibratory screed portions and the isolation of vibratory forces to the screed portion permits a more effective transmission of such forces to the asphalt pavement, and the application of greater compaction forces through the screed plate than had previously been thought possible without increasing the total mass of the assembly. It has also been found that such an arrangement of components of the screed assembly will act to limit the transmission of vibratory forces to the tractor of the paving machine. It is believed that preferred results may be obtained therefore, when the separate components of the screed assembly are provided such that the mass of the frame portion will include at least about 15% of the total mass of the screed assembly, and more preferably about 20–85% of the total mass of the screed assembly. The mass of the frame portion of screed assembly 22, for example, is preferably within a middle range of about 40–70% of the total mass of the screed assembly. Depending on the specific configuration of the frame and vibratory screed portions of the screed assembly, and depending on the characteristics of the paving material being applied and on other conditions such as ambient temperature and humidity, it may be necessary to add counterweights or auxiliary weights (not shown) to the frame portion of the assembly to achieve the desired mass distribution. If such added weights are desired, they should preferably be placed in a balanced fashion across the frame portion. If weights are added to the frame portion of assembly 22, the mass of the frame portion could approach the upper end of the preferred range of 20–85%.

Preferably, the means for isolating the vibratory forces created by the vibratory assembly to the screed portion includes at least one elastomeric pad, such as pad 56A, that is positioned between the vibratory assembly and the frame portion. Pad 56A may be made of natural or synthetic rubber or other suitable elastomeric material. In addition, particularly good results may be obtained when vibratory screed portion 38A is provided with a plurality of attachment plates 58A, arranged in pairs, that are attached to frame 40A by welding or other suitable means, and prescreed 28A is provided with an attachment member for each pair of attachment plates. Preferably, the attachment members are provided in the form of an elongate box tube, such as tube 60A, which is pivotally attached to frame 30A of prescreed 28A by means of joining members 62A, one of which is disposed on either side of the box tube and shafts 64A, which are inserted into holes aligned with axis 36 through the pair of joining members and the box tube therebetween. The other end of each such box tube is disposed between a pair of attachment plates 58A of the vibratory portion 38A, with an elastomeric pad 56A positioned on either side of the box tube between the tube and the adjacent attachment plates. This means of attachment between the vibratory screed portion and the frame portion (or the prescreed) will limit the transmission of vibration created by the vibratory assembly to the frame portion, and permit the vibratory forces to be concentrated and maximized on the vibratory screed portion so as to be applied thereby through the screed plate to the underlying road surface.

Figure 5:
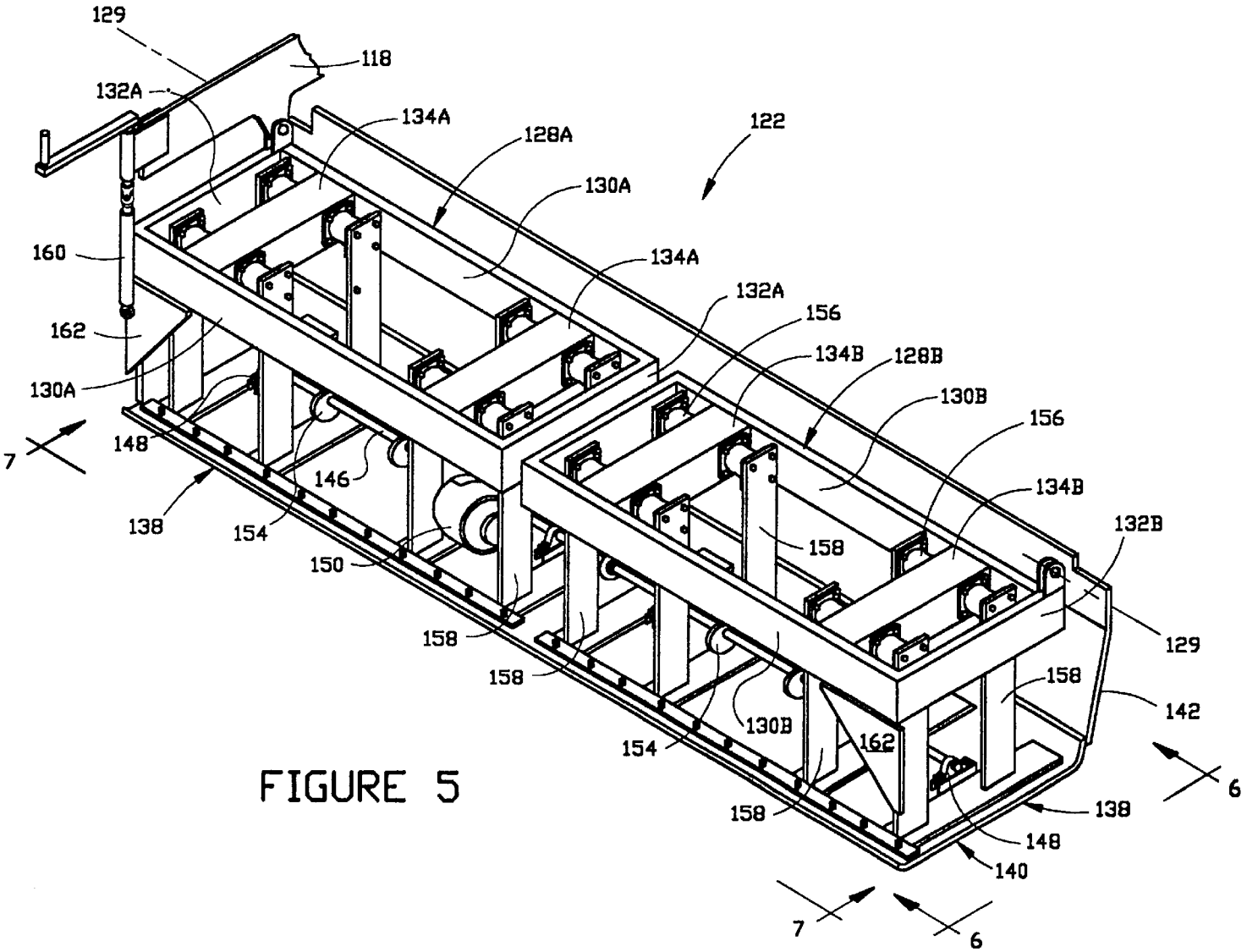
FIG. 5 is a perspective view of a second embodiment of the improved vibratory screed assembly described and claimed herein.
Figure 6:
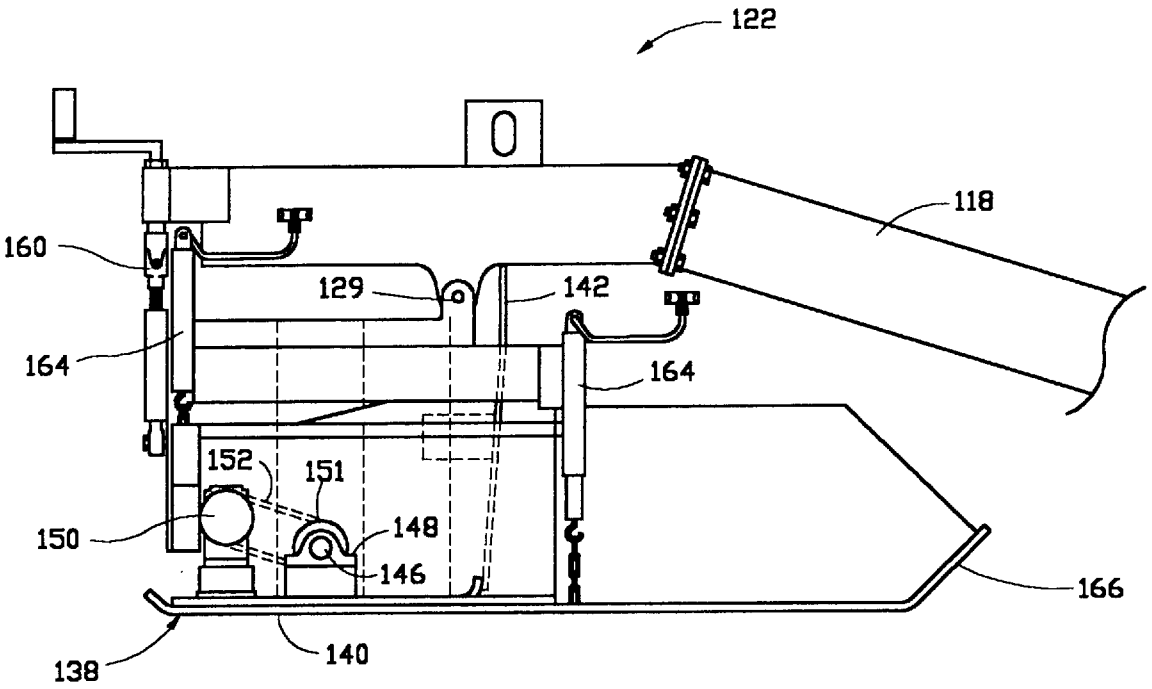
FIG. 6 is a side view of the vibratory screed assembly of FIG. 5, taken along lines 6—6.
Figure 7:
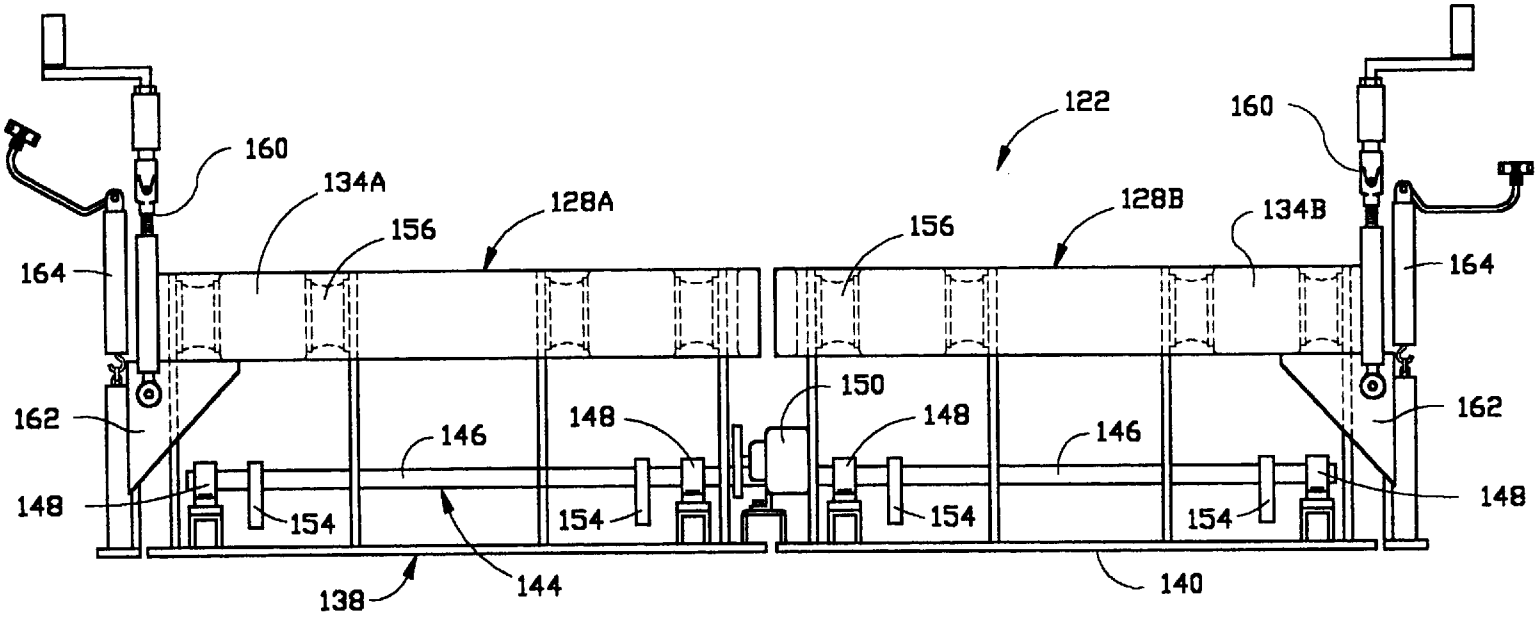
FIG. 7 is a rear view of the vibratory screed assembly of FIG. 5, taken along lines 7—7.

Referring now to FIGS. 5 through 7, a second embodiment of the improved vibratory screed assembly is illustrated. This embodiment, assembly 122, includes a frame portion 128 that is adapted for attachment to a paving machine, such as paving machine 10 of FIG. 1, through side arms 118, as shown in FIGS. 5 and 6, although the paving machine is not shown.

Preferably, assembly 122 includes a pair of rectangular frame portions 128A and 128B, disposed side-by-side, as shown in FIGS. 5 and 7. As used herein, the letters "A" and "B" following numerals will designate identical or mirror-image components of portions of the second preferred embodiment of the invention, assembly 122. The frame portions are preferably pivotally attached to the paving machine through the side arms so as to be capable of pivoting about pivot axis 129 or another axis that is disposed parallel to the surface of the roadway and transverse to the direction of travel of the paving machine. Although embodiment 122 preferably includes two rectangular frame portions 128A and 128B, a single frame portion 128 spanning substantially the width of assembly 122 could also be employed.

Frame portion 128A is a generally rectangular structural member comprised of a pair of parallel longitudinal members 130A and a pair of end members 132A. Attachment members 134A bridge the span between the longitudinal members 130A, and are joined to the associated vibratory screed portion, as will be subsequently explained. Preferably, all of these components of frame portion 128A are made of heavy-gauge steel or other suitable material, welded together or otherwise joined in a suitable fashion. As has been mentioned, it is preferred that the mass of the frame portion of the invention, which in the case of embodiment 122 includes frame portions 128A and 128B, include at least about 15% of the total mass of the screed assembly.

Assembly 122 also includes a vibratory screed portion that is adapted for attachment to the frame portion. Assembly 122 may include a pair of vibratory screed portions that are disposed side-by-side, similar to screed portions 38A and 38B of assembly 22, and in such case, each screed portion may be associated with one of frame portions 128A and 128B. However, as shown in FIGS. 5 and 7, the two frame portions 128A and 128B may be associated with a single vibratory screed portion 138. Vibratory screed portion 138 includes screed plate 140 that is disposed towards the surface of the roadway. Preferably, it also includes moldboard 142, which is attached to the side of the screed portion that is disposed towards the paving machine. It is also preferred that these components be made of heavy-gauge steel or other suitable material, and that moldboard 142 be attached by welding or other suitable means to screed plate 140. It may also be desirable to provide reinforcing members such as angle braces (not shown) to hold the moldboard in place in the vibratory screed portion. The moldboard is adapted to contact the asphalt concrete paving material that is deposited on the roadway by the paving machine so as to control the feed of paving material that is presented to the screed plate. In this fashion, the moldboard serves much the same function as the strike-off faces 32A and 32B of the prescreeds 28A and 28B of assembly 22. In addition, vibratory screed portion 138 includes vibratory assembly 144, which is mounted to screed plate 140 so as to impart vibration thereto. Vibratory assembly 144 includes elongate shaft 146, and a means for rotating the shaft. Preferably, the shaft of the vibratory assembly is supported by and journaled in at least one bearing assembly, such as assemblies 148. Vibratory assembly 144 also includes means for rotating shaft 146, such as motor 150, which may preferably be of hydraulic or electric motive power. The motor may be operatively attached to the shaft by means of pulley 151 and belt 152, as shown in FIG. 6, or by any other convenient means of attachment.

The vibratory screed portion may be provided in any convenient length, or any convenient number of assembly portions such as is illustrated in FIGS. 2 through 4 may be provided and joined together in the manner of the first embodiment of the invention illustrated therein or in another known manner to provide an assembly of the desired width. It is also contemplated that if multiple screed portions are provided, a motor may be provided for each vibratory screed portion, or a motor may be selected so as to power two or more such vibratory screed portions.

Vibratory assembly 144 also includes at least one eccentric weight 154 that is mounted on the shaft, said weight having a non-symmetrical distribution of mass about the shaft so that vibration will be created upon rotation thereof. Preferably, the vibratory assembly includes a plurality of such weights that are mounted on the shaft in such fashion that they have a non-symmetrical distribution of mass about the shaft so that vibration will be created upon rotation thereof. If a plurality of vibratory screed portions are utilized, such as is illustrated in FIGS. 2 and 4, it is preferred that the rotation of the shafts be synchronized and the alignment of the eccentric weights thereon be aligned so that vibratory forces created on one vibratory screed portion are not canceled by such forces created on another vibratory screed portion, but instead that they reinforce each other.

Ideally, the improved screed assembly that is described herein may be utilized to provide a degree of compaction to the asphalt concrete mat of at least about 98%. This amount of compaction may be achieved because the improved screed assembly includes a frame portion that is a separate component of the assembly from the vibratory screed portion, and because the vibratory screed portion is isolated from the frame portion so as to limit the transmission of vibratory forces to the frame portion of the assembly and to concentrate the transmission of such forces to the asphalt pavement. It is believed that the provision of separate frame and vibratory screed portions and the isolation of vibratory forces to the screed portion permits a more effective transmission of such forces to the asphalt pavement, and the application of greater compaction forces through the screed plate than had previously been thought possible without increasing the total mass of the assembly. It has also been found that such an arrangement of components of the screed assembly will act to limit the transmission of vibratory forces to the tractor of the paving machine. It is believed that preferred results may be obtained therefore, when the separate components of the screed assembly are provided such that the mass of the frame portion will include at least about 15% of the total mass of the screed assembly, and more preferably about 20–85% of the total mass of the screed assembly. The mass of the frame portion of screed assembly 122, for example, is preferably within a lower range of about 20–40% of the total mass of the screed assembly. Depending on the specific configuration of the frame and vibratory screed portions of the screed assembly, and depending on the characteristics of the paving material being applied and on other conditions such as ambient temperature and humidity, it may be necessary to add counterweights or auxiliary weights (not shown) to the frame portion of the assembly to achieve the desired mass distribution. If such added weights are desired, they should preferably be placed in a balanced fashion across the frame portion.

Preferably, the means for isolating the vibratory assembly includes at least one elastomeric pad, such as pad 156, that is positioned between the vibratory assembly and the frame portion. Pad 156 may be made of natural or synthetic rubber or other suitable elastomeric material. In addition, particularly good results may be obtained when vibratory screed portion 138 is provided with a plurality of attachment plates 158, arranged in pairs, that are attached to screed plate 140 by welding or other suitable means. If desired, the attachment plates can also be provided with reinforcing members such as angle braces (not shown) to hold the attachment plates to the screed plate. When attachment plates 158 are employed, frame portions 128A and 128B may be provided with an attachment member 134 for each pair of attachment plates. Preferably, the attachment members 134 are provided in the form of an elongate box tube that is welded into place between longitudinal members 130. Each attachment member is disposed between at least one and preferably two pairs of attachment plates 158 of the vibratory portion 138, with an elastomeric pad 156 positioned on either side of the attachment member between the member and the adjacent attachment plates. This means of attachment between the vibratory screed portion and the frame portion will limit the transmission of vibration created by the vibratory assembly to the frame portion, and permit the vibratory forces to be concentrated and maximized on the vibratory screed portion so as to be applied thereby through the screed plate to the underlying road surface.

Other known features of a screed assembly that may be associated with the invention include angle-of-attack screw 160 (only one of which is shown in FIG. 5), which may be used to adjust the angle of attack of the screed assembly, and its associated attachment plate 162. Also shown in FIGS. 6 and 7 are the two end gate jacks 164, which may be used to raise and lower end gate 166, which is attached to the end of the screed assembly to retain the paving material being laid on the roadway beneath the screed as paving is carried out.

Operation of the invention will compact the surface layer of asphalt concrete material to a high degree, as shown at 66 in FIG. 1. Preferably, by selecting the mass of the frame portion to include at least about 15% of the total mass of the assembly, and more preferably about 20–85%, such material will be compacted to a degree of at least about 98%. The degree of compaction can also be affected, as will be appreciated by those having ordinary skill in the art to which the invention relates, by the selection and size of the motor, the selection and arrangement of the eccentric weights, as well as by the mass of the screed plate and the total mass of the vibratory screed assembly.

Although this description contains many specifics, these should not be construed as limiting the scope of the invention but as merely providing illustrations of some of the presently preferred embodiments thereof, as well as the best mode contemplated by the inventor of carring out the invention. The invention, as described herein, is susceptible to various modifications and adaptations, and the same are intended to be comprehended within the meaning and range of equivalents of the appended claims.

What is claimed is:

1. A screed assembly for an asphalt concrete paving machine that is used to pave the surface of a roadway with asphalt concrete paving material, which screed assembly comprises:

(A) a frame portion that is adapted for attachment to the paving machine;

(B) a vibratory screed portion that is adapted for attachment to the frame portion, said vibratory screed portion including:

(i) a screed plate that is disposed towards the surface of the roadway, and (ii) a vibratory assembly which is mounted to the screed plate so as to impart vibration thereto, said vibratory assembly comprising:

(a) an elongate shaft, (b) means for rotating the shaft, and (c) an eccentric weight that is mounted on the shaft, said weight having a non-symmetrical distribution of mass about the shaft so that vibration will be created upon rotation thereof; and (C) means for isolating the vibratory assembly of the vibratory screed portion from the frame portion so as to limit the transmission of vibration created by the vibratory assembly to the frame portion.

2. The screed assembly of claim 1, wherein the mass of the frame portion includes at least about 15% of the total mass of the screed assembly.

3. The screed assembly of claim 1, wherein the mass of the frame portion includes at least about 20–85% of the total mass of the screed assembly.

4. The screed assembly of claim 1, wherein the shaft is supported by and journaled in at least one bearing assembly, and a hydraulic motor is provided for rotating the shaft.

5. The screed assembly of claim 1, wherein the vibratory assembly includes a plurality of eccentric weights that are mounted on the shaft in such fashion that the plurality of weights have a non-symmetrical distribution of mass about the shaft so that vibration will be created upon rotation thereof.

6. The screed assembly of claim 1, wherein at least one elastomeric pad is positioned between the vibratory assembly and the frame portion so as to limit the transmission of vibration created by the vibratory assembly to the frame portion.

7. The screed assembly of claim 1, wherein the frame portion comprises a prescreed that is adapted for pivotal attachment to the paving machine about an axis that is generally parallel to the surface of the roadway, said prescreed including a strike-off face that is disposed towards the paving machine and a leveling face that is disposed towards the surface of the roadway.

8. The screed assembly of claim 7, which includes a pair of prescreeds, disposed side-by-side, and a pair of vibratory screed portions, also disposed side-by-side.

9. The screed assembly of claim 8, wherein the shafts of the vibratory assemblies are joined together with a flexible coupling, and means are provided for rotating both shafts together.

10. The screed assembly of claim 7, wherein the vibratory screed portion is adapted for pivotal attachment to the prescreed about an axis that is generally parallel to the surface of the roadway.

11. The screed assembly of claim 1, wherein the vibratory screed portion includes a moldboard that is attached to the screed plate and disposed towards the paving machine, which moldboard is adapted to contact asphalt concrete paving material that is deposited on the roadway by the paving machine, and wherein the vibratory assembly is arranged so as to impart vibration to the moldboard as well as to the screed plate.

12. The screed assembly of claim 1, wherein the frame portion comprises a generally rectangular structural member that is adapted for pivotal attachment to the paving machine about an axis that is generally parallel to the surface of the roadway.

13. A screed assembly for an asphalt concrete paving machine that is used to pave the surface of a roadway with asphalt concrete paving material, which screed assembly comprises:

(A) a frame portion that is adapted for attachment to the paving machine:

(B) a vibratory screed portion that is adapted for attachment to the frame portion, said vibratory screed portion including:

(i) a screed plate that is disposed towards the surface of the roadway, and (ii) a vibratory assembly which is mounted to the screed plate so as to impart vibration thereto, said vibratory assembly comprising:

(a) an elongate shaft, (b) means for rotating the shaft, and (c) an eccentric weight that is mounted on the shaft, said weight having a non-symmetrical distribution of mass about the shaft so that vibration will be created upon rotation thereof, wherein the vibratory screed portion is provided with a plurality of attachment plates, arranged in pairs, that are attached to the screed plate, and wherein the frame portion is provided with an attachment member for each pair of attachment plates, with each such attachment member being attached to the frame portion and also being attached to the vibratory screed portion between a pair of attachment plates, and wherein an elastomeric pad is positioned on either side of the attachment member between said member and the adjacent attachment plates so as to limit the transmission of vibration created by the vibratory assembly to the frame portion.

14. The screed assembly of claim 13, wherein the frame portion comprises a prescreed that is adapted for pivotal attachment to the paving machine about an axis that is generally parallel to the surface of the roadway said prescreed including a strike-off face that is disposed towards the paving machine and a leveling face that is disposed towards the surface of the roadway, and wherein each attachment member of the frame portion is pivotally attached to the prescreed.

15. The screed assembly of claim 14, wherein the attachment members are provided in the form of an elongate box tube.

16. The screed assembly of claim 13, wherein the frame portion comprises a generally rectangular structural member that is adapted for pivotal attachment to the paving machine about an axis that is generally parallel to the surface of the roadway.

17. In a self-propelled paving machine for use in paving the surface of a roadway with asphalt concrete paving material, which paving machine includes a tractor having drive means for propelling the machine along the surface of a roadway, a hopper for holding a quantity of asphalt concrete paving material and means for conveying the paving material from the hopper to the roadway behind the machine, an improved screed assembly which comprises:

(A) a frame portion that is adapted for attachment to the paving machine;

(B) a vibratory screed portion that is adapted for attachment to the frame portion, said vibratory screed portion including:

(i) a screed plate that is disposed towards the surface of the roadway, and (ii) a vibratory assembly which is mounted to the screed plate so as to impart vibration thereto, said vibratory assembly comprising:

(a) an elongate shaft, (b) means for rotating the shaft, and (c) a plurality of eccentric weights that are mounted on the shaft in such fashion that the plurality of weights have a non-symmetrical distribution of mass about the shaft so that vibration will be created upon rotation thereof; and (C) means for isolating the vibratory assembly of the vibratory screed portion from the frame portion so as to limit the transmission of vibration created by the vibratory assembly to the frame portion.

18. The improved screed assembly of claim 17, wherein the mass of the frame portion includes at least about 15% of the total mass of the screed assembly.

19. A method for paving a roadway with asphalt concrete paving material comprising:

(A) providing a mobile paving machine that is adapted to deposit a quantity of asphalt concrete paving material on a roadway as it travels therealong;

(B) providing a screed assembly that is attached to the paving machine and adapted to be pulled behind such machine, said assembly comprising: (i) a frame portion that is adapted for attachment to the paving machine; (ii) a vibratory screed portion that is adapted for attachment to the frame portion, said vibratory screed portion including: (a) a screed plate that is disposed towards the surface of the roadway, (b) a vibratory assembly which is mounted to the screed plate so as to impart vibration thereto, said vibratory assembly comprising: (1) an elongate shaft, (2) means for rotating the shaft, and (3) an eccentric weight that is mounted on the shaft, said weight having a non-symmetrical distribution of mass about the shaft so that vibration will be created upon rotation thereof; (iii) means for isolating the vibratory assembly so as to limit the transmission of vibration created thereby to the frame portion; (iv) a plurality of attachment plates, arranged in pairs, that are attached to the screed plate, ; (v) an attachment member for each pair of attachment plates, with each such attachment member being attached to the frame portion and also being attached to the vibratory screed portion between a pair of attachment plates; (vi) a plurality of elastomeric pads that are positioned between the vibratory assembly and the frame portion, wherein one such pad is positioned on either side of the attachment member between said member and the adjacent attachment plates, so as to limit the transmission of vibration created by the vibratory assembly to the frame portion and to maximize the transmission of compacting forces to the asphalt concrete paving material on the roadway;

(C) depositing a quantity of asphalt concrete paving material on the roadway;

(D) activating the vibratory assembly to level, smooth and compact the asphalt concrete paving material on the roadway.

20. The method of claim 19, which includes providing the frame portion with a mass of at least about 15% of the total mass of the screed assembly.

* * * * *